US005524856A

United States Patent [19]

Neely et al.

[11] Patent Number: 5,524,856

[45] Date of Patent: Jun. 11, 1996

[54] RAIL BRACKET FLAG HOLDER

[76] Inventors: Gene Neely, 5801 Enterprise Dr. C3, Lincoln, Nebr. 68521; Michael R. Shriner, 7700 Seawall #412, Galveston, Tex. 77551

[21] Appl. No.: 251,196

[22] Filed: May 31, 1994

[51] Int. Cl.[6] ..... 401K 94/10

[52] U.S. Cl. ..... 248/534; 248/538; 248/214; 248/231.61

[58] Field of Search ..... 248/534, 538, 248/214, 228, 231.6, 316.6, 314

[56] References Cited

U.S. PATENT DOCUMENTS

| | | | |
|---|---|---|---|
| 818,937 | 4/1906 | Burden | 248/534 |
| 1,815,353 | 7/1931 | Gerow et al. | 248/538 |
| 2,541,146 | 2/1951 | Bahr | 248/538 |
| 3,315,926 | 4/1967 | Trenda et al. | 248/538 |
| 3,511,106 | 5/1970 | Deeby | 248/538 |

*Primary Examiner*—Karen J. Chotkowski
*Assistant Examiner*—Gwendolyn Wrenn

[57] ABSTRACT

With today's more mobile population and the increase in apartment dwellers, we feel there is a possible market for a flag bracket holder which is portable and leaves no damaging holes or marks on buildings. Many apartment dwellers have no other place to display a flag than on their balconies.

The Rail Bracket Holder For Flag provides a secure and stable base for the flag bracket without damaging property. Common bolts and wing nuts make it easy to affix or remove for relocation. The enclosed drawings provide the physical properties of this item.

The Rail Bracket Holder For Flag consists of two metal plates. One with sides to brace itself against the uprights of the railing and one with an angled lip to secure against the top of the railing.

Each plate having 3 holes. The plates are placed on opposite sides of the railing and held in place by 3 bolts with wing nuts, which also attach the standard flag bracket (provided by others). The bolts passing first through the flag bracket, then the first plate, between the uprights and through the other plate.

1 Claim, 2 Drawing Sheets

RAIL BRACKET FLAG HOLDER

BACKGROUND OF THE INVENTION

1. Field of the Invention

This invention relates generally to flag accessories and more particularly to a novel bracket to attach flags to a railing and not cause damage to the area. It will also provide a secure socket for the support of a flag mast therein.

2. Description of the Prior Art

On holidays and during festive times many people wish to display flags but with so many people living in apartments or other rental properties they do not have the means to do so without making holes in walls, etc.

SUMMARY OF THE INVENTION

The invention claimed is a novel rail bracket flag holder which is intended to be detachably mounted to any porch or balcony railing or other railing of this type. It would be easily mounted or dismounted and would cause no damage to buildings or walls.

The invention claimed provides a rail bracket flag holder that is movable and adjustable. That can easily be removed and taken with the owner when they move.

The invention claimed provides a rail bracket flag holder that is relatively simple in construction and which therefore may be readily manufactured at a relatively low cost and by simple manufacturing methods utilizing readily available materials such that it can be retailed at a sufficiently low price to encourage widespread use and acceptance thereof.

The invention claimed provides a rail bracket flag holder that is easy to use, stable, and reliable.

The invention claimed provides a rail bracket flag holder which is aesthetically pleasing and refined in appearance.

The invention claimed provides a rail bracket flag holder which is of a rugged and durable construction and which therefore may be guaranteed by the manufacturer to withstand many years of intended usage.

We claim that the other features and advantages of this invention will be apparent during the course of the following description.

BRIEF DESCRIPTION OF THE DRAWINGS

In the accompanying drawings forming s part of this specification, and in which like reference characters are employed to designate like parts throughout the same.

DESCRIPTION OF THE PREFERRED EMBODIMENT

Figure 1:
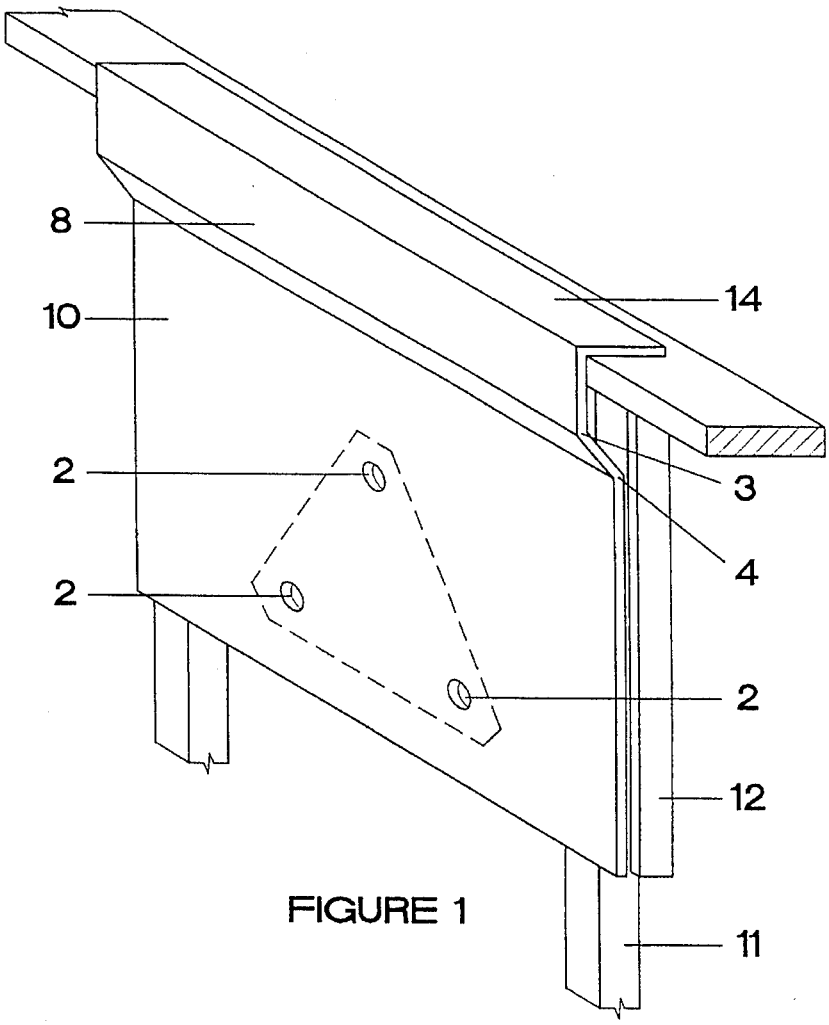
FIG. 1 is an isometric view of the Rail Bracket Flag Holder mounted to a railing, showing the typical position for a flag holder (provided by others).
Figure 2:
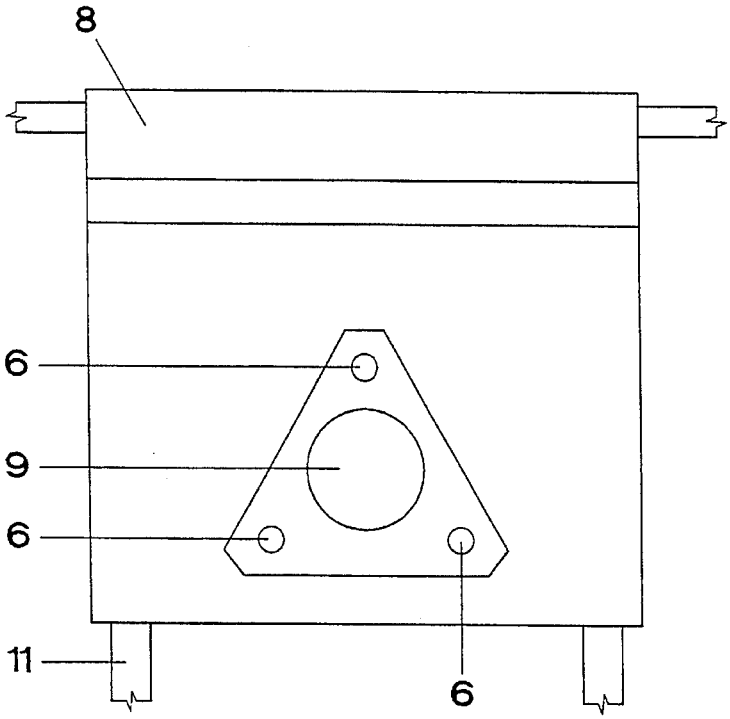
FIG. 2 is a front elevation of the Rail Bracket Flag Holder mounted to a railing.

Referring now to the drawings in detail there is illustrated a preferred form of a Rail Bracket Flag Holder constructed in accordance with the principles of the present invention and which is designated generally in its entirety by the reference numeral (10) and which is composed of three component parts, namely a standard flag holder (9); a rigid front plate formed to conform to standard railings; a back plate (7) formed to conform to the uprights of said railing (11) to be used with front plate and mounting bolts (6) with wing nuts (5). The third angled offset portion (14) having a first and second edges is elongated to a distance more than the offset of said plate, thus allowing the use with various styles of railing assemblies.

The front plate (8) is formed of rigid material, having three formed offsets (4), (3) and (14) having respective first and second edges near its top edge and three holes (2). The back plate is formed of rigid material, having flanges (12) at its side and elongated mounting holes (13). The standard flag holder (9) having a plate portion is available at most stores. The bolts and wing nuts are readily available at most stores.

Figure 3:
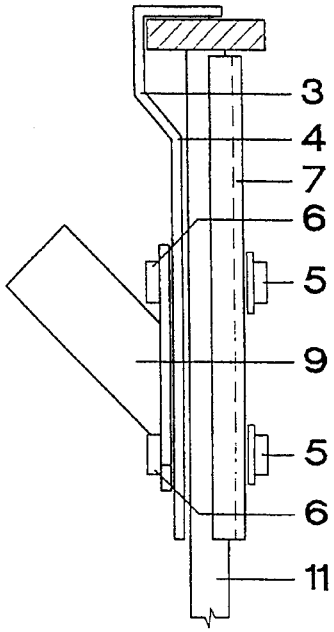
FIG. 3 is the side elevational view of the Rail Bracket Flag Holder.
Figure 4:
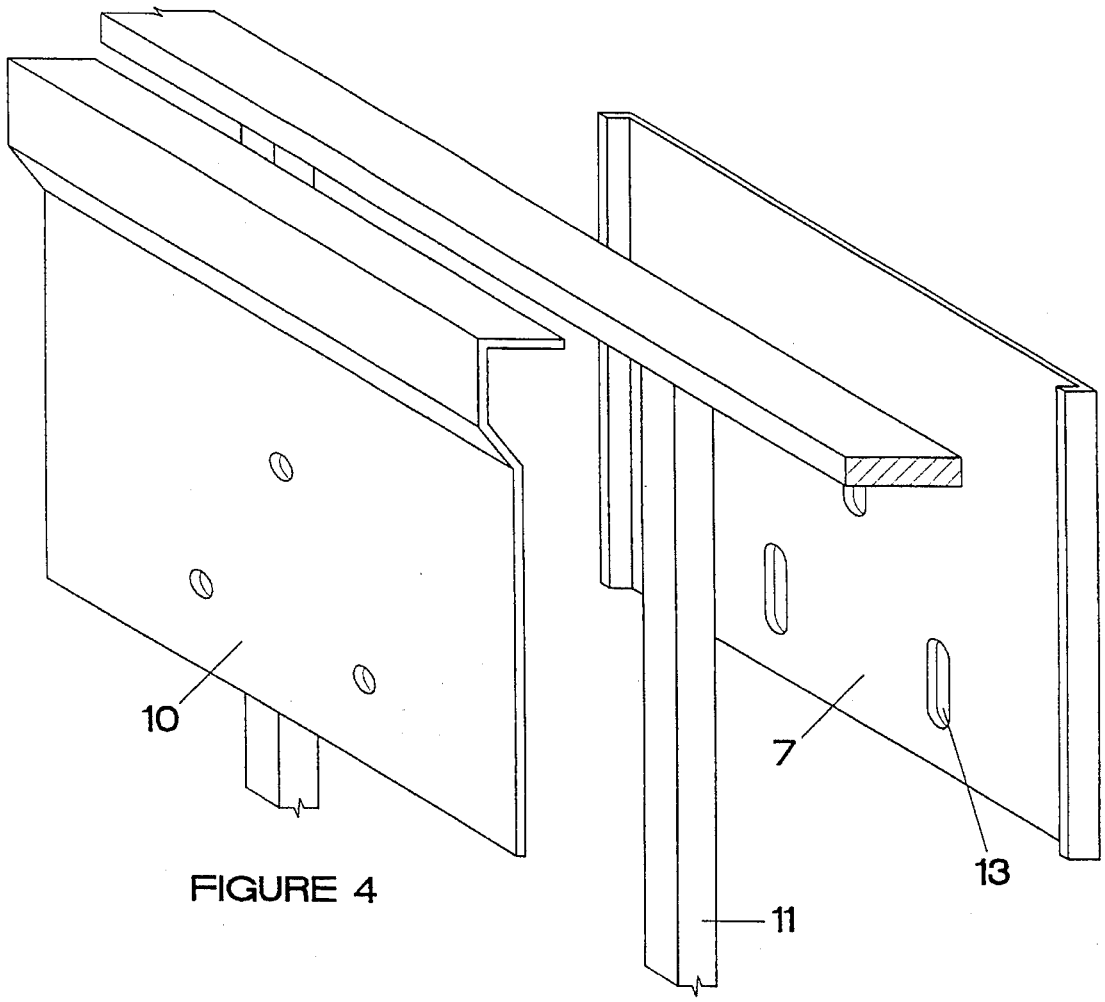
FIG. 4 is a blown-out view of the Rail Bracket Flag Holder mounted to the rail.
Figure 5:
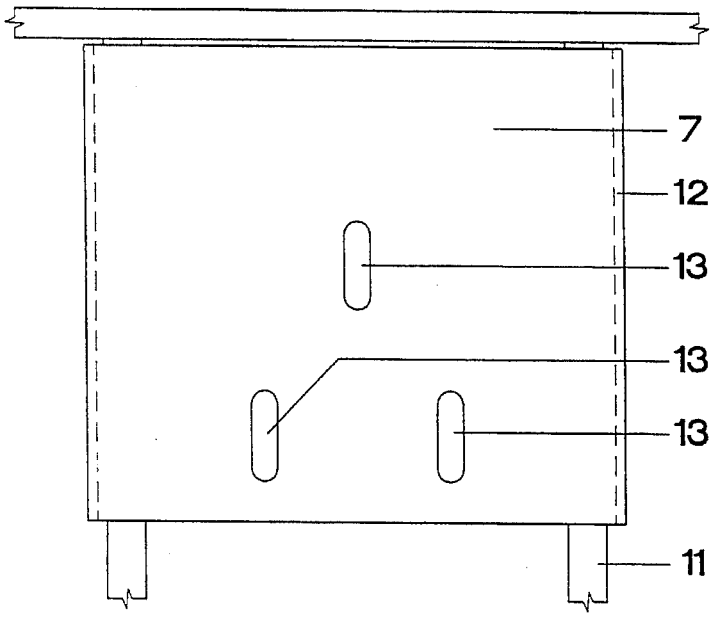
FIG. 5 is a back view of the Rail Bracket Flag Holder mounted to the rail.

As shown in FIG. 3 the bolts (6) are placed through the standard flag holder (9) and then through the holes in front plate (8), this is then positioned on the railing as shown and back plate (7) is positioned so that the bolts go through the holes and wing nuts (5) are affixed to bolts. This will provide a steady base for the flag.

The standard flag holder (9) is available in any store. The standard flag holder (9) is attached to the rail bracket flag holder as described above.

The pole or mast of a flag is then easily inserted into the standard flag holder to be removably supported therein.

There is thus provided a novel flag holder readily detachable mounted to a railing: and in the like manner requiring no damage thereto and providing a socket for the proper support of the mast or pole of a pennant or flag pole or the like.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size and arrangement of parts may be resorted to without departing from the spirit of the invention, the scope of the novel concepts thereof, or the scope of the sub-joined claims.

We claim:

1. A railing flag bracket assembly intended to be removably mounted to a railing comprising:

a front plate which is formed of a rigid material, a first angled offset portion having first and second edges, a top edge of said front plate being secured to said first edge of said first offset portion, a second angled offset portion having first and second edges, said first edge of said second angled offset portion secured to said second edge of said first offset portion, said second offset portion being substantially parallel with said front plate, a third angled offset portion having a first edge secured to said second edge of said second offset portion, said third offset portion being substantially perpendicular to said second offset portion, a back plate which is formed of a rigid material having a top, bottom, and side edges, each said side edge having a flange extending substantially perpendicular therefrom, said front plate and said back plate having a plurality of holes in corresponding relationship, a flag holder having a plate portion having a plurality of holes in corresponding relationship with said holes of said front plate and said back plate, whereby bolt means may be used to secure said flag holder, said front plate and said back plate together on a railing system so that said third angled offset portion overlaps and is supported on a top surface of a horizontal rail of said railing system and said flanges of said back plate are adapted to overlie a side surface of each of two vertical extending posts of said rail system.

* * * * *